US007770665B2

(12) United States Patent
Eia et al.

(10) Patent No.: US 7,770,665 B2
(45) **Date of Patent: *Aug. 10, 2010**

(54) USE OF CUTTINGS TANK FOR IN-TRANSIT SLURRIFICATION

(75) Inventors: Jan Thore Eia, Kvernaland (NO); Gordon M. Logan, Aberdeen (GB)

(73) Assignee: M-I LLC, Houston, TX (US)

( * ) Notice: Subject to any disclaimer, the term of this patent is extended or adjusted under 35 U.S.C. 154(b) by 163 days.

This patent is subject to a terminal disclaimer.

(21) Appl. No.: 12/020,439

(22) Filed: Jan. 25, 2008

(65) Prior Publication Data

US 2008/0179097 A1 Jul. 31, 2008

Related U.S. Application Data

(60) Provisional application No. 60/887,449, filed on Jan. 31, 2007, provisional application No. 60/991,606, filed on Nov. 30, 2007.

(51) Int. Cl.
*E21B 21/01* (2006.01)
*E21B 21/06* (2006.01)

(52) U.S. Cl. ..... 175/66; 175/88; 175/209

(58) Field of Classification Search ..... None
See application file for complete search history.

(56) References Cited

U.S. PATENT DOCUMENTS 5,129,469 A 7/1992 Jackson
5,303,786 A * 4/1994 Prestridge et al. ..... 175/66
6,179,071 B1 1/2001 Dietzen
6,698,989 B2 3/2004 Snowdon et al.
6,702,539 B2 3/2004 Snowdon et al.
6,709,216 B2 3/2004 Snowdon et al.
6,745,856 B2 6/2004 Simpson et al.
2002/0033278 A1 * 3/2002 Reddoch ..... 175/57

FOREIGN PATENT DOCUMENTS

WO 9904134 1/1999

OTHER PUBLICATIONS

PCT International Search Report issued in PCT Application No. PCT/US2008/052520 dated Jul. 28, 2008 (4 pages).
PCT Written Opinion issued in PCT Application No. PCT/US2008/052520 dated Jul. 28, 2008 (4 pages).

* cited by examiner

*Primary Examiner*—Zakiya W. Bates
(74) *Attorney, Agent, or Firm*—Osha • Liang LLP

(57) ABSTRACT

A system for preparing a slurry in-transit including a first cuttings storage vessel disposed on a transport vehicle, a module configured to operatively connect to the first cuttings storage vessel, and a fluid supply line in fluid communication with the first cuttings storage vessel, the module including, a grinding device configured to facilitate the transfer of fluids and reduce particle size of drill cuttings, wherein the system is operated while the transport vehicle is moving. A method of operating an in-transit slurrification system including using a first vessel disposed on a moving transport vehicle for cuttings storage, and operating the first vessel in a slurrification process while the transport vehicle is moving.

23 Claims, 8 Drawing Sheets

USE OF CUTTINGS TANK FOR IN-TRANSIT SLURRIFICATION

CROSS-REFERENCE TO RELATED APPLICATIONS

This application, pursuant to 35 U.S.C. §119(e), claims priority to U.S. Provisional Application Ser. No. 60/887,449, filed Jan. 31, 2007, and U.S. Provisional Application Ser. No. 60/991,606, filed Nov. 30, 2007. Both applications are incorporated by reference in their entireties.

BACKGROUND

1. Field

Embodiments disclosed herein generally relate to a slurrification system and a method of operating a slurrification system. More specifically, embodiments disclosed herein relate to a slurrification system and a method of operating a slurrification system on a transport vehicle in-transit between work sites.

2. Background Art

In the drilling of wells, a drill bit is used to dig many thousands of feet into the earth's crust. Oil rigs typically employ a derrick that extends above the well drilling platform. The derrick supports joint after joint of drill pipe connected end-to-end during the drilling operation. As the drill bit is pushed further into the earth, additional pipe joints are added to the ever lengthening "string" or "drill string". Therefore, the drill string typically includes a plurality of joints of pipe.

Fluid "drilling mud" is pumped from the well drilling platform, through the drill string, and to a drill bit supported at the lower or distal end of the drill string. The drilling mud lubricates the drill bit and carries away well cuttings generated by the drill bit as it digs deeper. The cuttings are carried in a return flow stream of drilling mud through the well annulus and back to the well drilling platform at the earth's surface. When the frilling mud reaches the platform, it is contaminated with small pieces of shale and rock that are known in the industry as well cuttings or drill cuttings. Once the drill cuttings, drilling mud, and other waste reach the platform, a "shale shaker" is typically used to remove the drilling mud from the drill cuttings so that the drilling mud may be reused. The remaining drill cuttings, waste, and residual drilling mud are then transferred to a holding trough for disposal. In some situations, for example with specific types of drilling mud, the drilling mud may not be reused and it must be disposed. Typically, the non-recycled drilling mud is disposed of separate from the drill cuttings and other waste by transporting the drilling mud via a vessel to a disposal site.

The disposal of the drill cuttings and drilling mud is a complex environmental problem. Drill cuttings contain not only the residual drilling mud product that would contaminate the surrounding environment, but may also contain oil and other waste that is particularly hazardous to the environment, especially when drilling in a marine environment.

In the Gulf of Mexico, for example, there are hundreds of drilling platforms that drill for oil and gas by drilling into the subsea floor. These drilling platforms may be used in places where the depth of the water is many hundreds of feet. In such a marine environment, the water is typically filled with marine life that cannot tolerate the disposal of drill cuttings waste. Therefore, there is a need for a simple, yet workable solution to the problem of disposing of well drill cuttings, drilling mud, and/or other waste in offshore marine environments and other fragile environments.

Traditional methods of disposal include dumping, bucket transport, cumbersome conveyor belts, screw conveyors, and washing techniques that require large amounts of water. Adding water creates additional problems of added volume and bulk, pollution, and transport problems. Installing conveyors requires major modification to the rig area and involves extensive installation hours and expense.

Another method of disposal includes returning the drill cuttings, drilling mud, and/or other waste via injection under high pressure into an earth formation. In general, the injection process involves the preparation of a slurry within surface-based equipment, and pumping the slurry into a well that extends relatively deep underground into a receiving stratum or adequate formation. The basic steps in the process include the identification of an appropriate stratum or formation for the injection; preparing an appropriate injection well; formulation of the slurry, which includes considering such factors as weight, solids content, pH, gels, etc.; performing the injection operations, which includes determining and monitoring pump rates such as volume per unit time and pressure; and capping the well.

Material to be injected back into a formation must be prepared into a slurry acceptable to high pressure pumps used in pumping material down a well. The particles are usually not uniform in size and density, thus making the slurrification process complicated. If the slurry is not the correct density, the slurry often plugs circulating pumps. The abrasiveness of the material particles may also abrade the pump impellers causing cracking. Some centrifugal pumps may be used for grinding the injection particles by purposely causing pump cavitation.

In some instances, the cuttings, which are still contaminated with some oil, are transported from a drilling rig to an offshore rig or ashore in the form of a thick heavy paste or slurry for injection into an earth formation. Typically the material is put into special skips of about 10 ton capacity that are loaded by crane from the rig onto supply boats. This may be a difficult and dangerous operation that may be laborious and expensive.

U.S. Pat. No. 6,709,216 and related patent family members disclose that cuttings may also be conveyed to and stored in an enclosed, transportable vessel, where the vessel may then be transported to a destination, and the drill cuttings may be withdrawn. The transportable storage vessel has a lower conical section structured to achieve mass flow of the mixture in the vessel, and withdrawal of the cuttings includes applying a compressed gas to the cuttings in the vessel. The transportable vessels are designed to fit within a 20 foot ISO container frame. These conical vessels will be referred to herein as ISO vessels.

As described in U.S. Pat. No. 6,709,216 and family, the ISO vessels may be lifted onto a drilling rig by a rig crane and used to store cuttings. The vessels may then be used to transfer the cuttings onto a supply boat. The cuttings may be transferred by pipe lines or, alternatively, the storage vessels containing cuttings may be lifted off the rig by cranes and transported by a supply boat. When a supply boat is not present, the vessels may also serve as buffer storage.

Space on offshore platforms is limited. In addition to the storage and transfer of cuttings, many additional operations take place on a drilling rig, including tank cleaning, slurrification operations, drilling, chemical treatment operations, raw material storage, mud preparation, mud recycle, mud separations, and others.

Due to the limited space, it is common to modularize these operations and to swap out modules when not needed or when space is needed for the equipment. For example, cuttings containers may be offloaded from the rig to make room for modularized equipment used for slurrification. These lifting operations, as mentioned above, may be difficult, dangerous, and expensive. Additionally, many of these modularized operations are self contained, and therefore, include redundant equipment, such as pumps, valves, and tanks or storage vessels.

Slurrifications systems that may be moved onto a rig are typically large modules that are fully self-contained, receiving cuttings from a drilling rig's fluid mud recovery system. For example, PCT Publication No. WO 99/04134 discloses a process module containing a first slurry tank, grinding pumps, a system shale shaker, a second slurry tank, and optionally a holding tank. The module may be lifted by a crane on to an offshore drilling platform.

Slurrification systems may also be disposed in portable units that may be transported from one work site to another. As disclosed in U.S. Pat. No. 5,303,786, a slurrification system may be mounted on a semi-trailer that may be towed between work sites. The system includes, inter alia, multiple tanks, pumps, mills, grinders, agitators, hoppers, and conveyors. As discussed in U.S. Pat. No. 5,303,786, the slurrification system may be moved to a site where a large quantity of material to be treated is available, such as existing or abandoned reserve pits that hold large quantities of cuttings.

U.S. Pat. No. 6,745,856 discloses another transportable slurrification system that is disposed on a transport vehicle. The transport vehicle (i.e., a vessel or boat) is stationed proximate the work site (i.e., offshore platform) and connected to equipment located at the work site while in operation. Deleterious material is transferred from the work site to the transport vehicle, wherein the deleterious material is slurrified. The slurry may be transferred back to the work site for, in one example, re-injection into the formation. Alternatively, the slurry may be transported via the transport vehicle to a disposal site. As disclosed in U.S. Pat. No. 6,745,856, storage vessels are disposed on the transport vehicle for containing the slurry during transportation. While in-transit to the disposal site, agitators disposed in the storage vessels may agitate the slurry to keep the solids suspended in the fluid.

While theses systems and methods provide improved processes in slurrification and re-injection systems, they require difficult, dangerous, and expensive lifting and installation operations, as described above. Additionally, these processes may require lengthy installation and processing times that may reduce the overall efficiency of the work site.

Accordingly, there exists a continuing need for systems and methods for efficiently preparing and transporting slurries for re-injection.

SUMMARY

In one aspect, embodiments disclosed herein relate to a system for preparing a slurry in-transit, the system including a first cuttings storage vessel disposed on a transport vehicle, a module configured to operatively connect to the first cuttings storage vessel, and a fluid supply line in fluid communication with the first cuttings storage vessel, the module including, a grinding device configured to facilitate the transfer of fluids and reduce particle size of drill cuttings, wherein the system is operated while the transport vehicle is moving.

In another aspect, embodiments disclosed herein relate to a method of operating an in-transit slurrification system, the method including using a first vessel disposed on a moving transport vehicle for cuttings storage, and operating the first vessel in a slurrification process while the transport vehicle is moving.

In another aspect, embodiments disclosed herein relate to a method of converting a first cuttings storage vessel for use in an in-transit slurrification system, including connecting a module to at least the first cuttings storage vessel disposed on a transport vehicle, while the transport vehicle is moving, wherein the module includes a grinding device configured to facilitate the transfer of fluids, an inlet connection configured to an outlet of the first vessel, and an outlet connection configured to connect to an inlet of the first vessel.

In yet another aspect, embodiment disclosed herein relate to a method of operating an in-transit slurrification system, the method including transferring at least one material from a first vessel disposed at a work site to a storage assembly disposed on a transport vehicle via at least one transfer line, disconnecting the at least one transfer line from the storage assembly, connecting a slurrification module to the storage assembly, moving the transport vehicle away from the work site, and operating the in-transit slurrification system while the transport vehicle is moving.

Other aspects and advantages of embodiments disclosed herein will be apparent from the following description and the appended claims.

DETAILED DESCRIPTION

In one aspect, embodiments of the present disclosure relate to a system for preparing a slurry in-transit. In another aspect, embodiments of the present disclosure relate to a method of operating an in-transit slurrification system. In yet another aspect, embodiments of the present disclosure relate to a method of converting a first cuttings storage vessel for use in an in-transit slurrification system.

Figure 1:
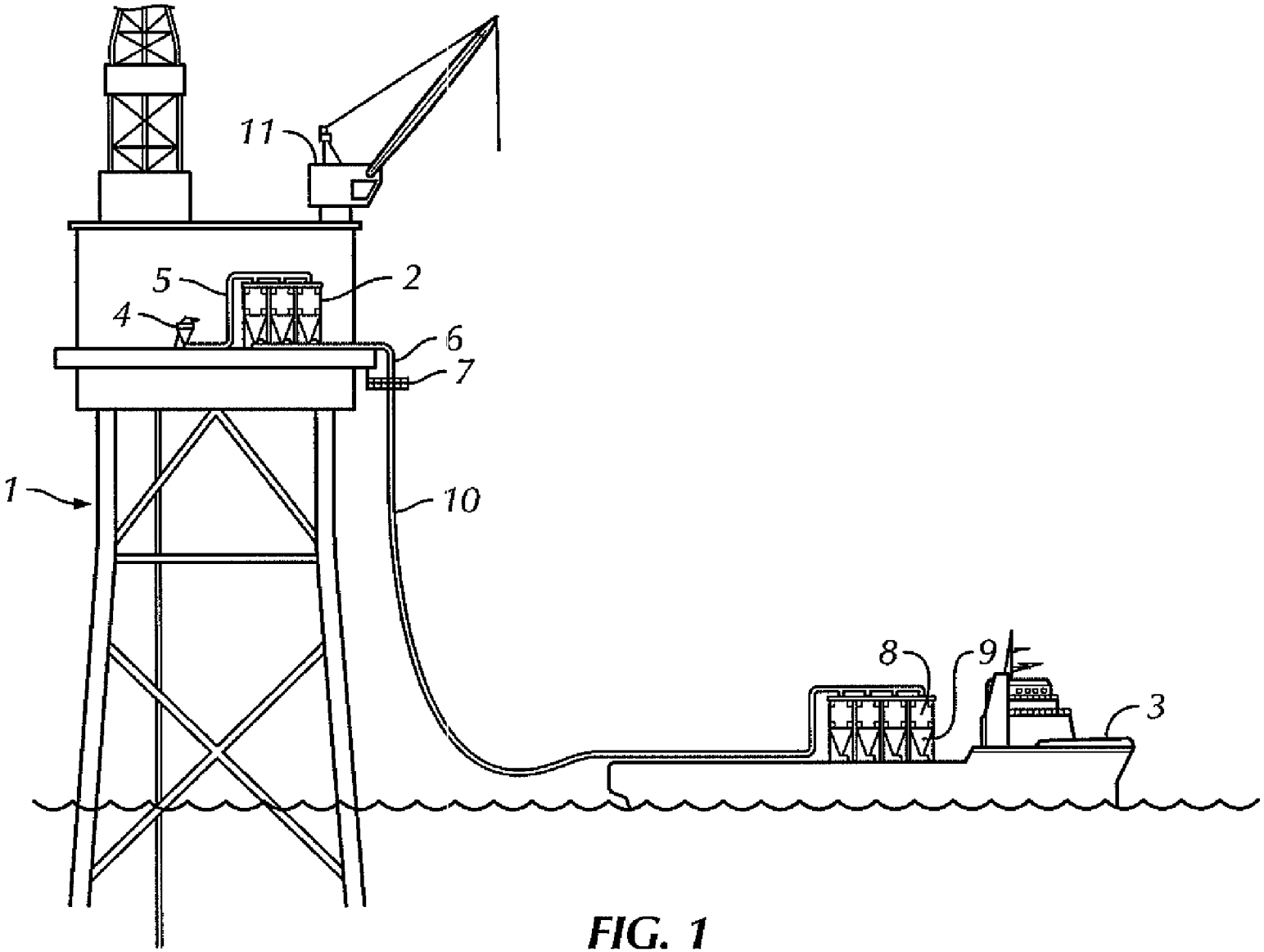
FIG. 1 shows a method of offloading drill cuttings from an off-shore rig in accordance with an embodiment of the present disclosure.

Referring initially to FIG. 1, a method of offloading drill cuttings from an off-shore drilling rig according to one embodiment of the present disclosure is shown. In this embodiment, an offshore oil rig 1 may have one or more cuttings storage vessels 2 located on its platform. Cuttings storage vessels 2 may include raw material storage tanks, waste storage tanks, or any other vessels commonly used in association with drilling processes. Specifically, cuttings storage vessels 2 may include cuttings boxes, ISO-tanks, and pneumatic conveying vessels. In some embodiments, cuttings storage vessels 2 may include several individual vessels connected to allow the transference of cuttings therebetween. Such cuttings storage vessels 2 may be located within a support framework (not shown), such as an ISO container frame. As such, those of ordinary skill in the art will appreciate that cuttings storage vessels 2 may be used for both drill cuttings storage and transport.

As described above with respect to prior art methods, when cuttings storage vessels 2 are no longer needed during a drilling operation, or temporarily not required for operations taking place on the drilling rig, cuttings storage vessels 2 may be offloaded to a transport vehicle, for example, a supply boat 3. Other systems and vessels for performing different operations may then be lifted onto the rig via crane 11, and placed where vessels 2 were previously located. In this manner, valuable rig space may be saved; however, conserving space in this manner may require many dangerous and costly crane lifts.

In contrast to the prior art methods describe above, embodiments disclosed herein integrate vessels 2 into two or more operations that are performed on drilling rig 1. In one aspect, embodiments disclosed herein relate to integrating cuttings storage vessels 2 to operate in at least two operations on rig 1. In some aspects, embodiments disclosed herein relate to integrating cuttings storage vessels 2 to be used for cuttings storage and/or transport, as well a second operation performed on a rig. More specifically, embodiments disclosed herein relate to using cuttings storage vessels 2 as both a storage/transfer vessel, as well as a component in a slurrification system. Although described with respect to integrating cuttings storage vessels into a slurrification system, one skilled in the art will appreciate that any vessel located at a drilling location or on a transport vehicle for a given operation may be integrated into the systems and methods for slurrification disclosed herein.

Referring still to FIG. 1, offshore oil rig 1 may include one or more cuttings storage vessels 2 located on its platform. Drill cuttings generated during the drilling process may be transferred to cuttings storage vessels 2 for storage and/or subsequent transfer in a number of different ways. One such method of transferring drill cuttings is via a pneumatic transfer system including a cuttings blower 4 and pneumatic transfer lines 5. Examples of systems using forced flow pneumatic transfer are disclosed in U.S. Pat. Nos. 6,698,989, 6,702,539, and 6,709,216, all incorporated by reference herein. However, those of ordinary skill in the art will appreciate that other methods for transferring cuttings from a separatory or cleaning operation (e.g., using vibratory separators) to cuttings storage vessels 2 may include augers, conveyors, and pneumatic suction or vacuum systems.

In a system using pneumatic cuttings transfer, when cuttings need to be offloaded from rig 1 to supply boat 3, cuttings may be discharged through pipe 6 to a hose connection pipe 7. Supply boat 3 is fitted with a storage assembly 8, wherein storage assembly 8 may include a number of additional cuttings storage vessels 9, including, for example, pneumatic conveying vessels. Supply boat 3 may be brought proximate to rig 1, and a flexible hose 10 extended therebetween. In this embodiment, flexible hose 10 connects storage assembly 8 to cuttings storage vessels 2 via connection pipe 7.

Figure 2:
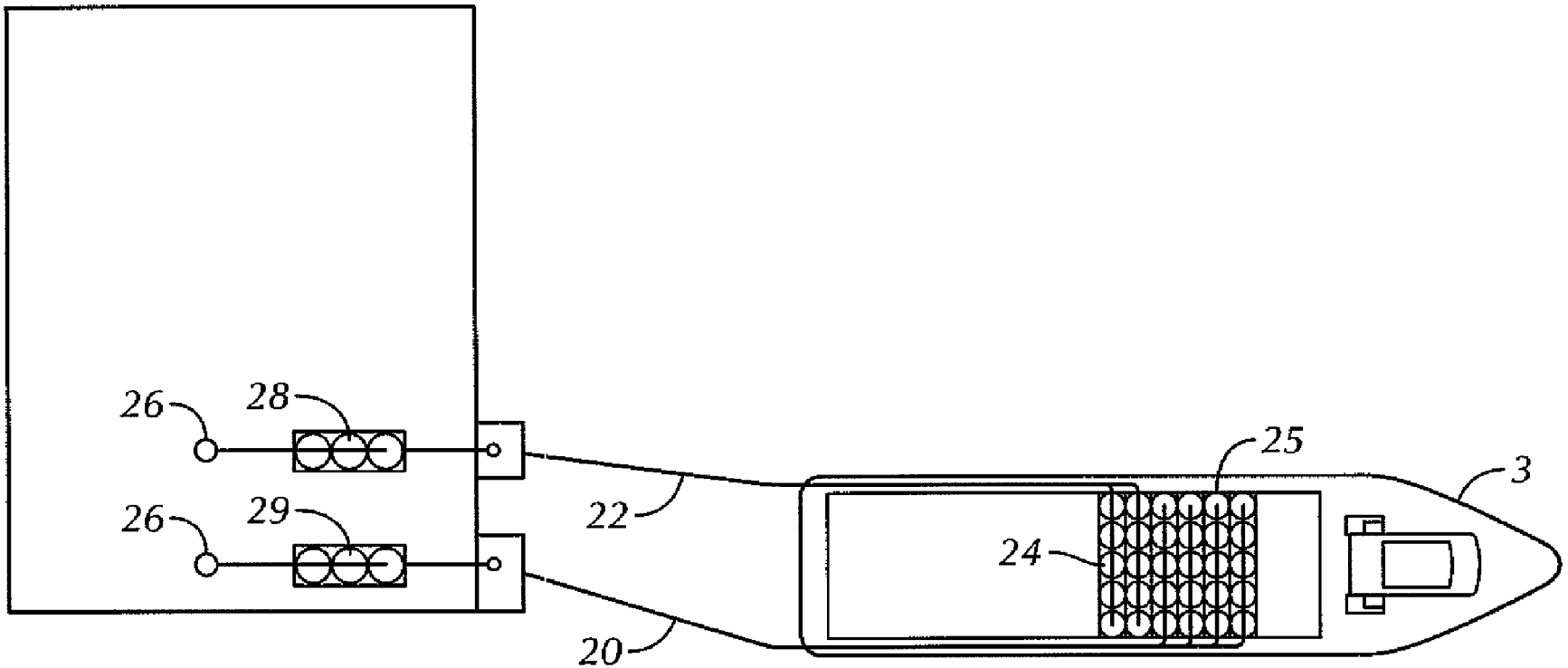
FIG. 2 shows a top view of a system for transferring material from an off-shore rig in accordance with an embodiment of the present disclosure.

In one embodiment, as shown in FIG. 2, two discrete streams of materials may be transferred contemporaneously (i.e., at least partially during the same time interval) to a transport vehicle, for example, supply boat 3. In this embodiment, a first supply line 20 may transfer a first material from at least a first storage vessel 29 to supply boat 3 and a second supply line 22 may transfer a second material from at least a second storage vessel 28 to supply boat 3. The first and second materials may be transferred to a cuttings storage assembly 25 disposed on supply boat 3, on and/or below the deck of the supply boat 3. Alternatively, the first and second materials may be transferred to a storage tank (not shown) disposed on or below the deck of supply boat 3.

In one embodiment, the first material may include dry cuttings, while the second material includes a fluid. One of ordinary skill in the art will appreciate that a fluid may include a liquid, a slurry, or a gelatinous material. Additionally, one of ordinary skill in the art will appreciate that dry cuttings may include cuttings processed by a separatory or cleaning system, and as such, may include small amounts of residual fluids, hydrocarbons, and/or other chemical additives used during the cleaning process. Pumps (not shown) may be coupled to the storage vessels 28, 29 to facilitate the transfer of material, including, for example, dry cuttings, a fluid, or a slurry, from a separatory or cleaning operation on the rig to supply boat 3. Alternatively, a pneumatic transfer system 26 may be coupled to the storage vessels 28, 29 to transfer materials, including dry cuttings, fluids, and slurries to supply boat 3. In one embodiment, the pneumatic transfer system 26 may include a forced flow pneumatic transfer system as disclosed in U.S. Pat. Nos. 6,698,989, 6,702,536, and 6,709,216. Providing contemporaneous transfer of discrete material streams (e.g., dry cuttings, fluids), may reduce the transportation time between a rig and a transport vehicle, such as, supply boat 3.

In one embodiment, cuttings storage assembly 25 may include at least one cuttings storage vessel 24. As such, the first material and the second material may be transferred to a single cuttings storage vessel 24 of cuttings storage assembly 25. In another embodiment, the first material and the second material may be transferred to separate cuttings storage vessels 24 of cuttings storage assembly 25. In one embodiment, a cutting storage vessel 24 disposed on the supply boat 3 may be used in a slurrification system, as disclosed below with reference to cuttings storage vessels disposed on a rig. In this embodiment, briefly, a module (not shown) may be operatively connected to the cuttings storage assembly 25 to incorporate existing cuttings storage vessels 24 into a slurrification system.

Integration of a cuttings storage vessel into a slurrification system is now described with respect to a cuttings storage vessel disposed on a rig. One of ordinary skill in the art, however, will appreciate that the cuttings storage vessel may be disposed at any work site, including a rig, a transport vehicle, or other treatment facility, without departing from the scope of embodiments disclosed herein. In this embodiment a module may be disposed at the work site proximate the cuttings storage vessel and operatively connected to the cuttings storage vessel, thereby converting the cuttings storage vessel from a vessel for storing cuttings to a component of a slurrification system.

As described above, previous fluid slurrification systems required the conversion of valuable drilling rig space for storing independent fluid recovery vessels and processing equipment. However, embodiments disclosed herein allow existing structural elements (i.e., cuttings storage vessels 202) to be used in multiple operations. Modules in accordance with embodiments disclosed herein are relatively small compared to previous systems, thereby preserving valuable drill space, and preventing the need for costly and dangerous lifting operations. Those of ordinary skill in the art will appreciate that the system as illustrated in FIGS. 1-3 and 5-6 are only exemplary, and alternate systems incorporating additional components, for example, fluid cleaning components or tank cleaning components, may also be used in combination with slurrification systems disclosed herein. Illustrative examples of such systems are described in greater detail below.

Figure 3:
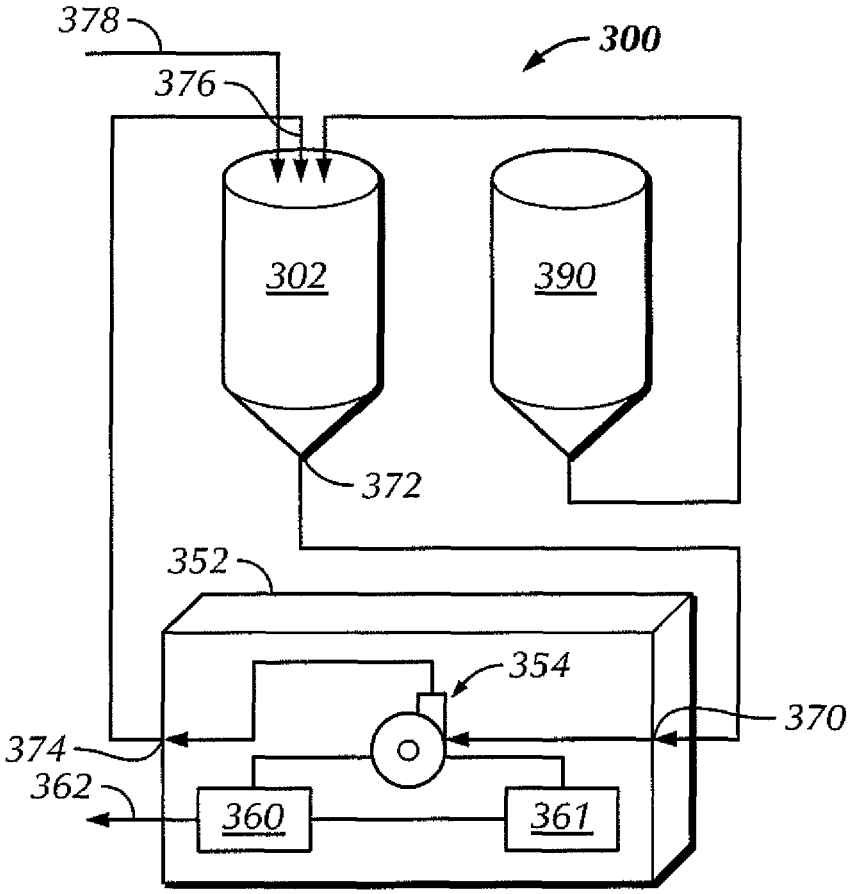
FIG. 3 shows a slurrification system in accordance with embodiments of the present disclosure.

Referring now to FIG. 3, a slurrification system 300 incorporating a first cuttings storage vessel 302 is illustrated. Slurrification system 300 includes a module 352, or drive unit, configured to operatively connect with the first cuttings storage vessel 302, and a fluid supply line 378. Module 352 may include a containment unit, a skid, a housing, or a moveable platform configured to house select slurrification system components, as described in more detail below.

In this embodiment, system 300 includes an independent power source 360 for providing power to components of module 352. Power source 360 is electrically connected to, for example, grinding device 354 and/or a programmable logic controller (PLC) 361. Those of ordinary skill in the art will appreciate that such a power source may provide primary or auxiliary power for powering components of module 352. In other embodiments, power source 360 may be merely an electrical conduit for connecting a power source on a rig (not shown) via an electrical cable 362, to module 352.

Module 352 includes an inlet connection 370 configured to connect with outlet 372 of first cuttings storage vessel 302, and an outlet connection 374 configured to connect with an inlet 376 of first cuttings storage vessel 302. Inlet connection 370 may be connected to outlet 372 and outlet connection 374 may be connected to inlet 376 by fluid transfer lines, for example, flexible hoses and/or new or existing piping. Module 352 further includes a grinding device 354 configured to facilitate the transfer of fluids from the first cuttings storage vessel 302, through the module 352, and back to the first cuttings storage vessel 302. Grinding device 354 is configured to reduce the particle size of solid materials of the drill cuttings transferred therethrough.

Figure 4:
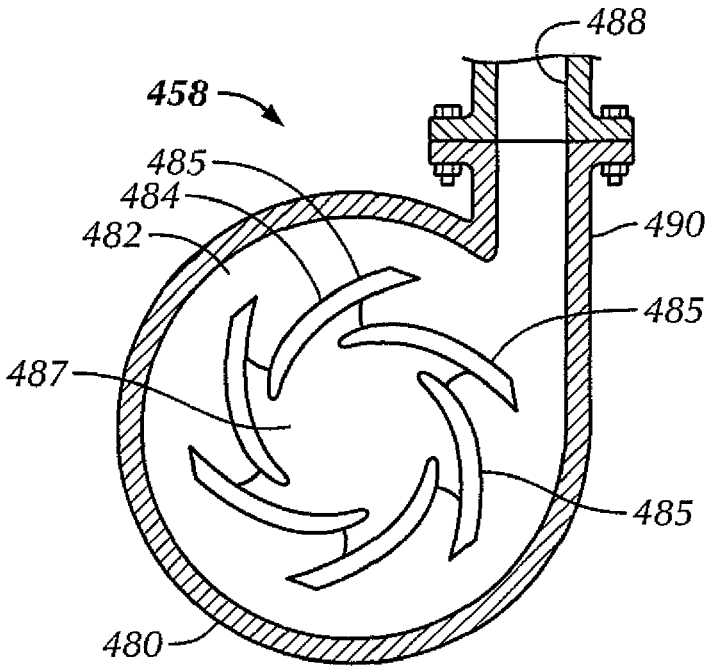
FIG. 4 shows a grinding device in accordance with embodiments of the present disclosure.

In one embodiment, grinding device 354 may include a grinding pump. The grinding pump may be, for example, a centrifugal pump, as disclosed in U.S. Pat. No. 5,129,469, and incorporated be reference herein. As shown in FIG. 4, a centrifugal pump 458, configured to grind or reduce the particle size of drill cuttings, may have a generally cylindrical casing 480 with an interior impeller space 482 formed therein. Centrifugal pump 458 may include an impeller 484 with backward swept blades with an open face on both sides, that is, the blades or vanes 485 are swept backward with respect to a direction of rotation of the impeller and are not provided with opposed side plates forming a closed channel between the impeller fluid inlet area 487 and the blade tips. The casing 480 has a tangential discharge passage 488 formed by a casing portion 490. The concentric casing of centrifugal pump 458 and the configuration of the impeller blades 485 provide a shearing action that reduces the particle size of drill cuttings. The blades 485 of the impeller 484 may be coated with a material, for example, tungsten carbide, to reduce wear of the blades 485. One of ordinary skill in the art will appreciate that any grinding pump known in the art for reducing the size of solids in a slurry may be used without departing from the scope of embodiments disclosed herein.

Figure 5:
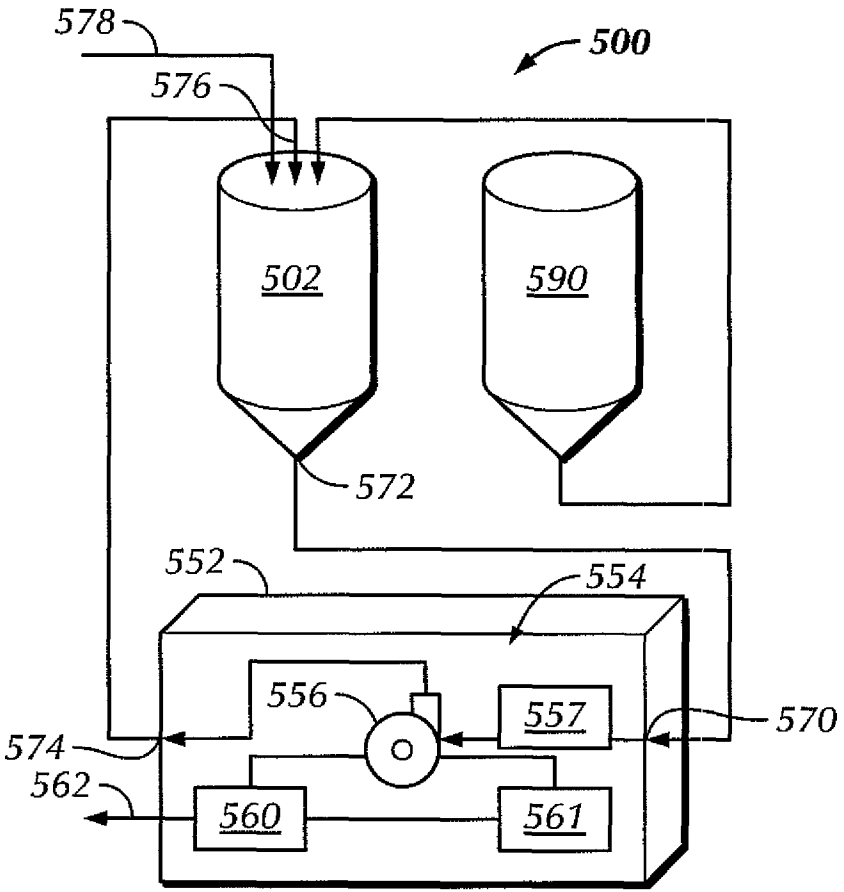
FIG. 5 shows a slurrification system in accordance with embodiments of the present disclosure.

In an alternative embodiment, as shown in FIG. 5, grinding device 554 may include a pump 556 and a grinder 557, for example, a ball mill. In this embodiment, cuttings may be injected into the grinder 557, wherein the particle size of the solids is reduced. The pump 556 may then pump the slurry back to first cuttings vessel 502. In one embodiment, the pump may include a grinding pump, as disclosed above, as a second grinder, for further reduction of the particle size of solids exiting the grinder 557.

Referring back to FIG. 3, in one embodiment, slurrification system 300 further includes a second cuttings storage vessel 390. Second cuttings storage vessel 390 may be configured to supply cuttings to first cuttings storage vessel 302. In one embodiment, a pump (not shown), as known in the art, may be used to transfer the cuttings. In another embodiment, a pneumatic transfer device (not shown), as disclosed above, may be used to transfer the cuttings to the first cuttings storage vessel 302. One of ordinary skill in the art will appreciate that any method for transferring the cuttings to first storage vessel 302 may be used without departing from the scope of embodiments disclosed herein.

In one embodiment, module 352 may further include a pneumatic control device (not shown) to control the flowrate of air injected into the cuttings storage vessel 302 by a pneumatic transfer device (not shown). In such an embodiment, and air line (not shown) from an air compressor (not shown) may be coupled to the pneumatic control device (not shown) in module 352 to control a flow of air into first cuttings storage vessel 302.

In another embodiment, cuttings may be supplied to first cuttings storage vessel 302 from a classifying shaker (not shown) or other cuttings separation or cleaning systems disposed on the drilling rig. Additionally, multiple cuttings storage vessels may be connected to and supply cuttings to first cuttings storage vessel 302. In one embodiment, each cuttings storage vessel may be configured to supply cuttings of predetermined sizes, for example, coarse cuttings or fines. Cuttings of a selected size may then be provided to first cuttings storage vessel 302 to form a slurry of a predetermined density. One of ordinary skill in the art will appreciate that the cuttings may be transferred to the first cuttings storage vessel 302 by any means known in the art, for example, by a pump or a pneumatic transfer device, as described above.

During operation of slurrification system 300, fluid supply line 378 may be configured to supply a fluid to first cuttings storage vessel 302. One of ordinary skill in the art will appreciate that the fluid supply line 378 may supply water, sea water, a brine solution, chemical additives, or other fluids known in the art for preparing a slurry of drill cuttings. As the fluid is pumped into first cuttings storage vessel 302, cuttings from the second cuttings storage vessel 390, or other components of the rig's cuttings separation system, as described above, may be transferred into first cuttings storage vessel 302.

As first cuttings storage vessel 302 fills with fluid and cuttings, the mixture of fluid and cuttings is transferred to module 352 through the inlet connection 370 of the module 352. In one embodiment, the mixture may be transferred by a pneumatic transfer device, a vacuum system, a pump, or any other means known in the art. In one embodiment, the pneumatic transfer device may include a forced flow pneumatic transfer system. The mixture of fluid and cuttings is pumped through grinding device 354, wherein the cuttings are reduced in size. The mixture, or slurry, is then pumped back to first cuttings storage vessel 302 via outlet connection 374. The slurry may cycle back through module 352 one or more times as needed to produce a slurry of a predetermined density or concentration of cuttings as required for the particular application or re-injection formation.

Figure 6:
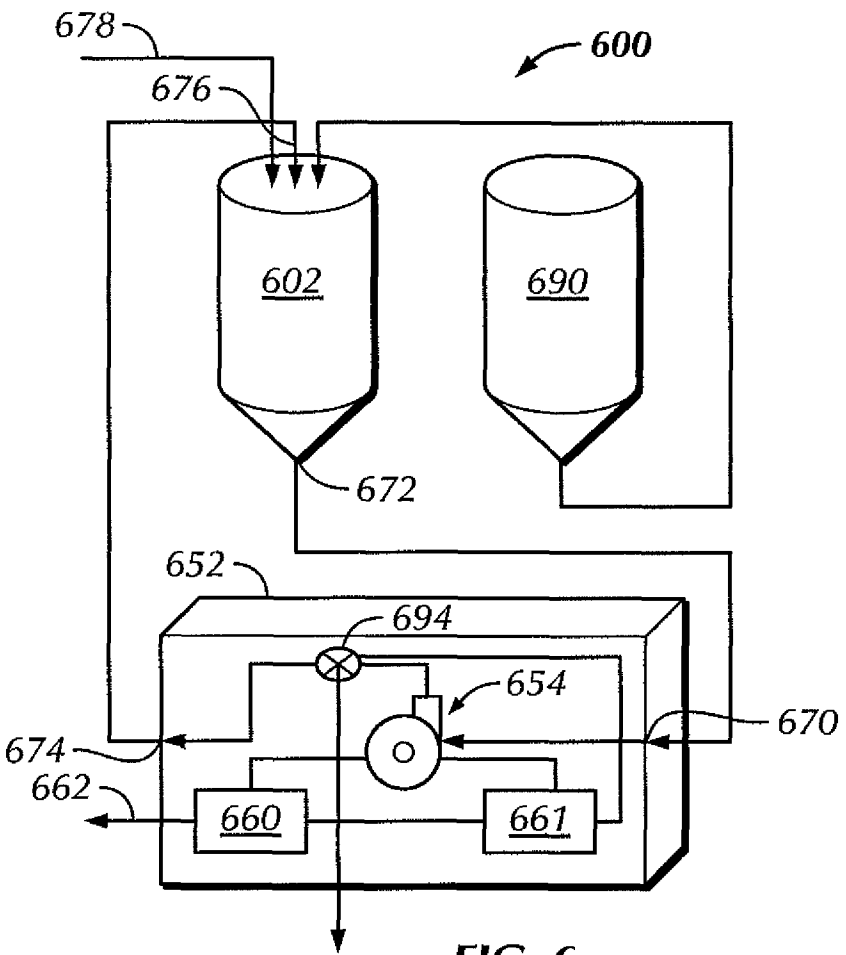
FIG. 6 shows a slurrification system in accordance with embodiments of the present disclosure.

Referring now to FIG. 6, in one embodiment, module 652 further includes a valve 694 disposed downstream of grinding device 654, wherein valve 694 is configured to redirect the flow of the slurry exiting the grinding device 654. In one embodiment, a PLC 661 may be operatively coupled to module 652 and configured to close or open the valve 694, thereby redirecting the flow of the slurry. In one embodiment, the PLC

695 may control the valve 694 to move after a pre-determined amount of time of fluid transfer through module 652. In another embodiment, a sensor (not shown) may be operatively coupled to the valve 694 to open or close the valve when a pre-determined condition of the slurry is met. For example, in one embodiment, a density sensor (not shown) may be coupled to valve 694, such that, when the density of the slurry exiting grinding device 654 reaches a pre-determined value, valve 694 moves, i.e., opens or closes, and redirects the flow of the slurry from the first cuttings storage vessel 602 to another cuttings storage vessel, a slurry tank, a skip, or injection pump for injection into a formation.

In another embodiment, a conductivity sensor (not shown) may be coupled to valve 694, such that, when the density of the slurry exiting grinding device 654 reaches a pre-determined value, valve 694 moves and redirects the flow of the slurry from the first cuttings storage vessel 602 to another cuttings storage vessel, a slurry tank, a skip, or injection pump for injection into a formation. One of ordinary skill in the art will appreciate that other apparatus and methods may be used to redirect the flow of the slurry once a predetermined concentration of cuttings in suspension, density, or conductivity has been met. Commonly, a slurry with a concentration of up to 20% cuttings in suspension is used for re-injection into a formation. However, those of ordinary skill in the art will appreciate that direct injection of slurry, using embodiments of the present disclosure, may provide for increases in concentration of cuttings in the slurry.

A slurry formed by a slurrification system, as described above, may be transferred to another cuttings storage vessel, a slurry tank, a skip, or directly injected into a formation. Slurry that is transferred to a tank, vessel, skip, or other storage device, may be transferred off-site to another work site. In one embodiment, the storage device may be lifted off of a rig by a crane and transferred to a boat. Alternatively, slurry may be transferred from the storage device to a slurry tank disposed on the boat.

In one embodiment, the slurry may be transported from one work site to another work site for re-injection. For example, the slurry may be transported from an offshore rig to another offshore rig. Additionally, the slurry may be transported from an offshore rig to an on-land work site. Further the slurry may be transported from an on-land work site to an offshore work site.

In another embodiment, as briefly discussed with reference to FIGS. 1 and 2 above, a module configured to prepare a slurry may be operatively connected to a cuttings storage assembly disposed on a transport vehicle (e.g., a trailer or a boat). In this embodiment, at least one material may be transferred by, for example, a pneumatic transfer device, as described above, from a work site to the transport vehicle via one or more transfer lines. The module and operatively coupled cuttings storage assembly are disposed on the transport vehicle to provide a system for preparing a slurry while the transport vehicle is moving. As used herein, the term 'moving' is defined as in-transit from one location to another, such that the overall displacement of the transport vehicle from a work site or initial position is measured as a horizontal displacement.

Figure 7A:
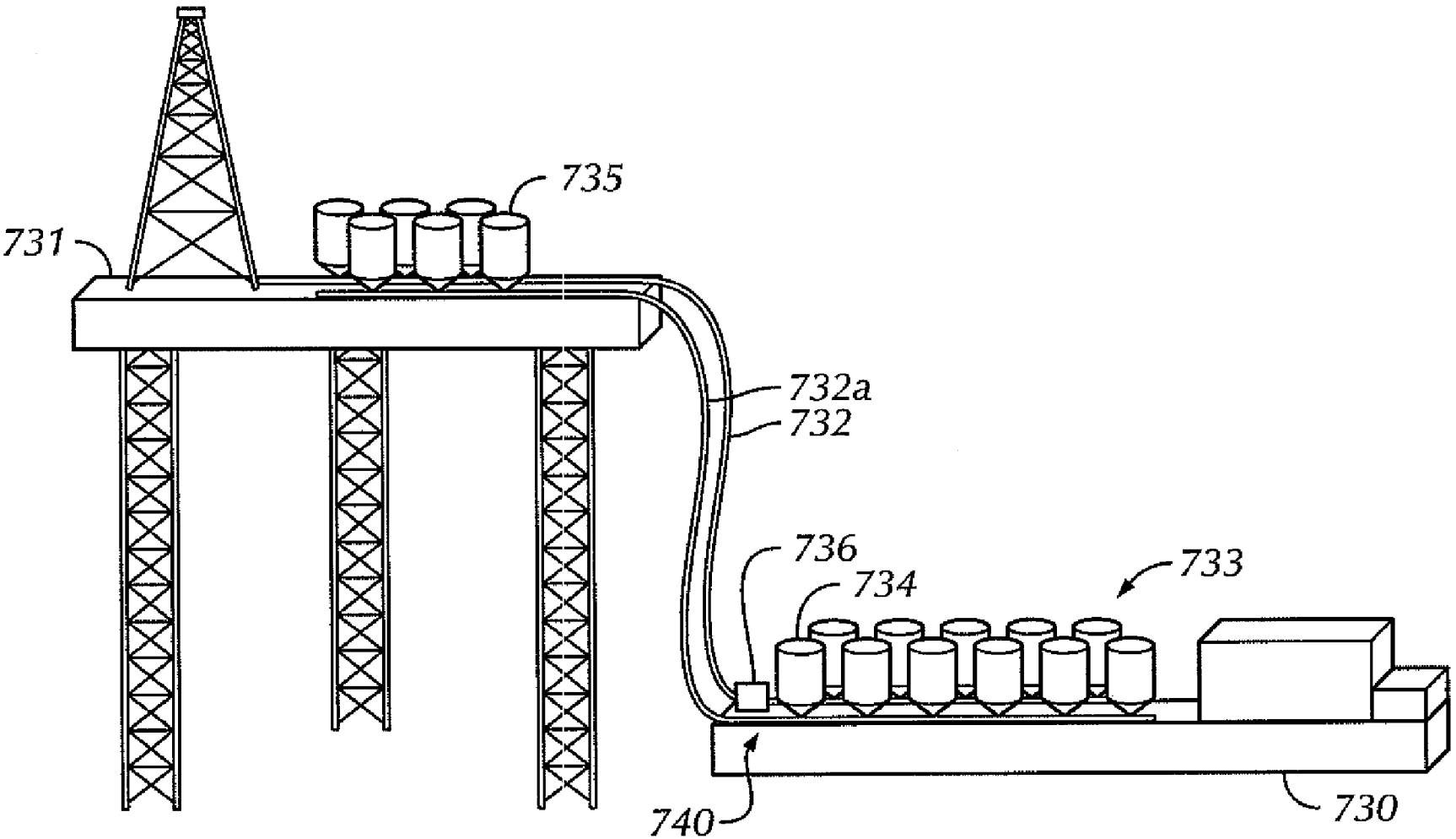
FIGS. 7A, 7B, and 7C show an in-transit slurrification system in accordance with embodiments of the present disclosure.
Figure 7B:
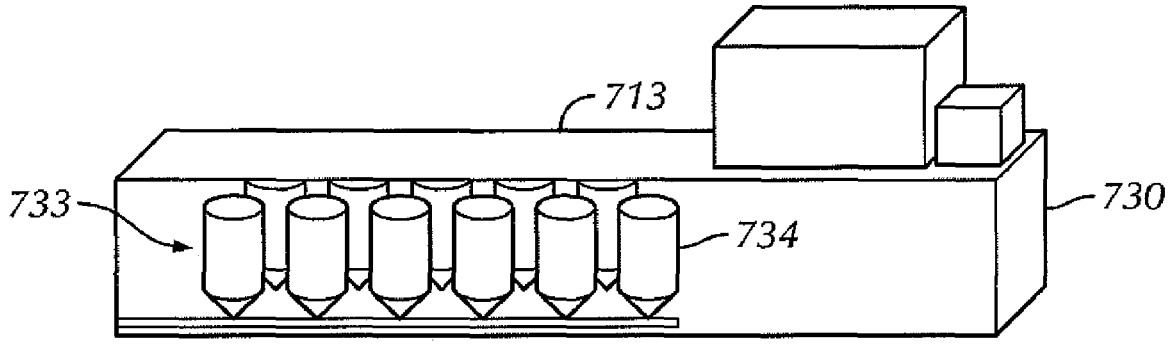
Figure 7C:
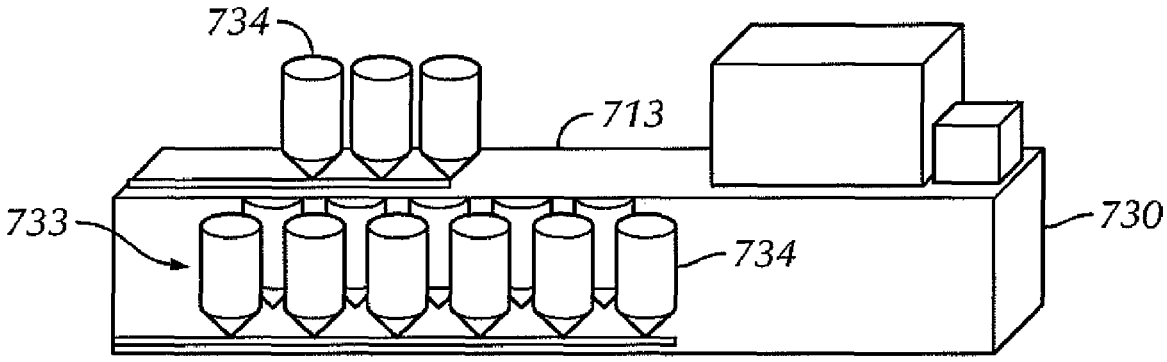
Figure 8:
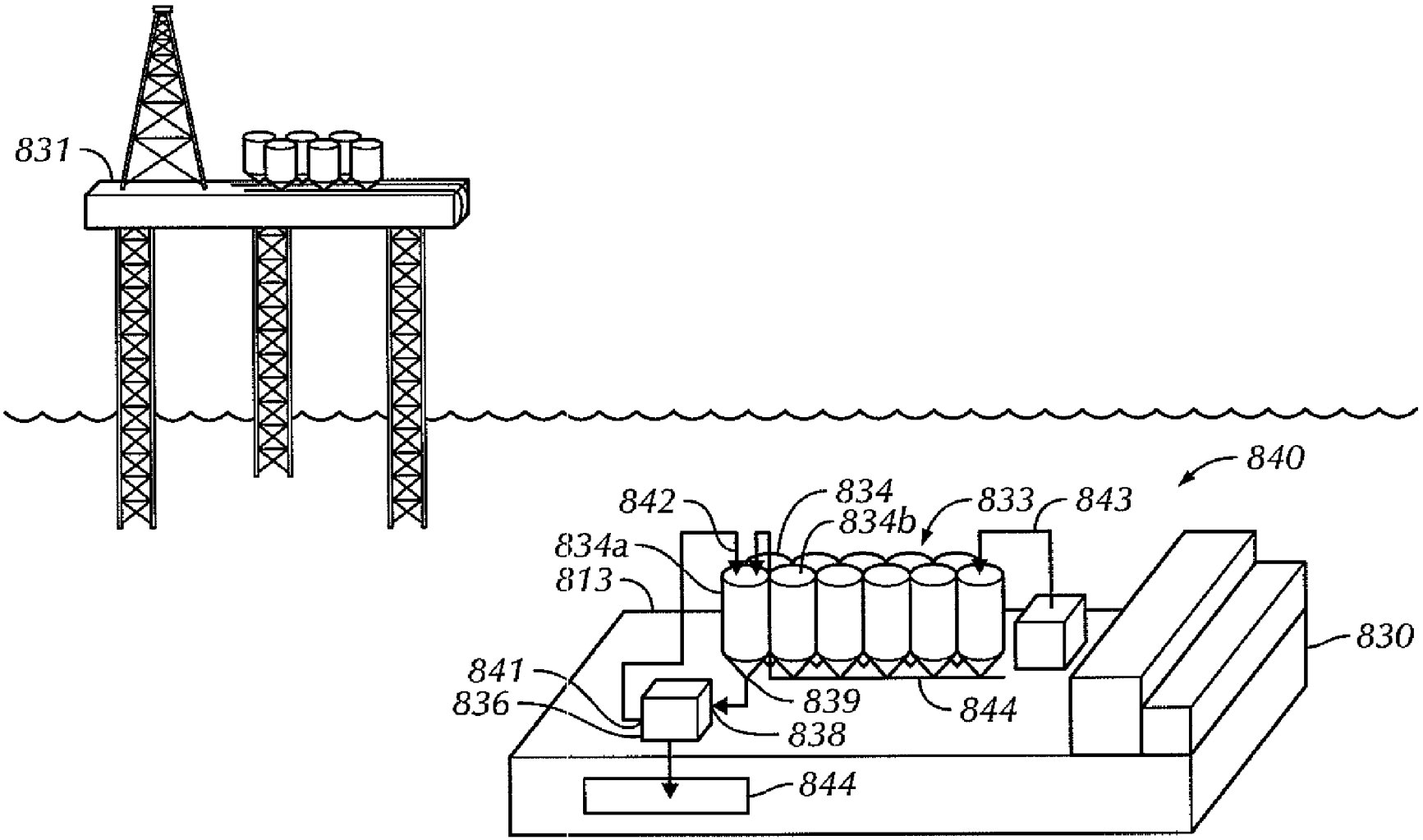
FIG. 8 shows an in-transit slurrification system in accordance with embodiments of the present disclosure.
Figure 9:
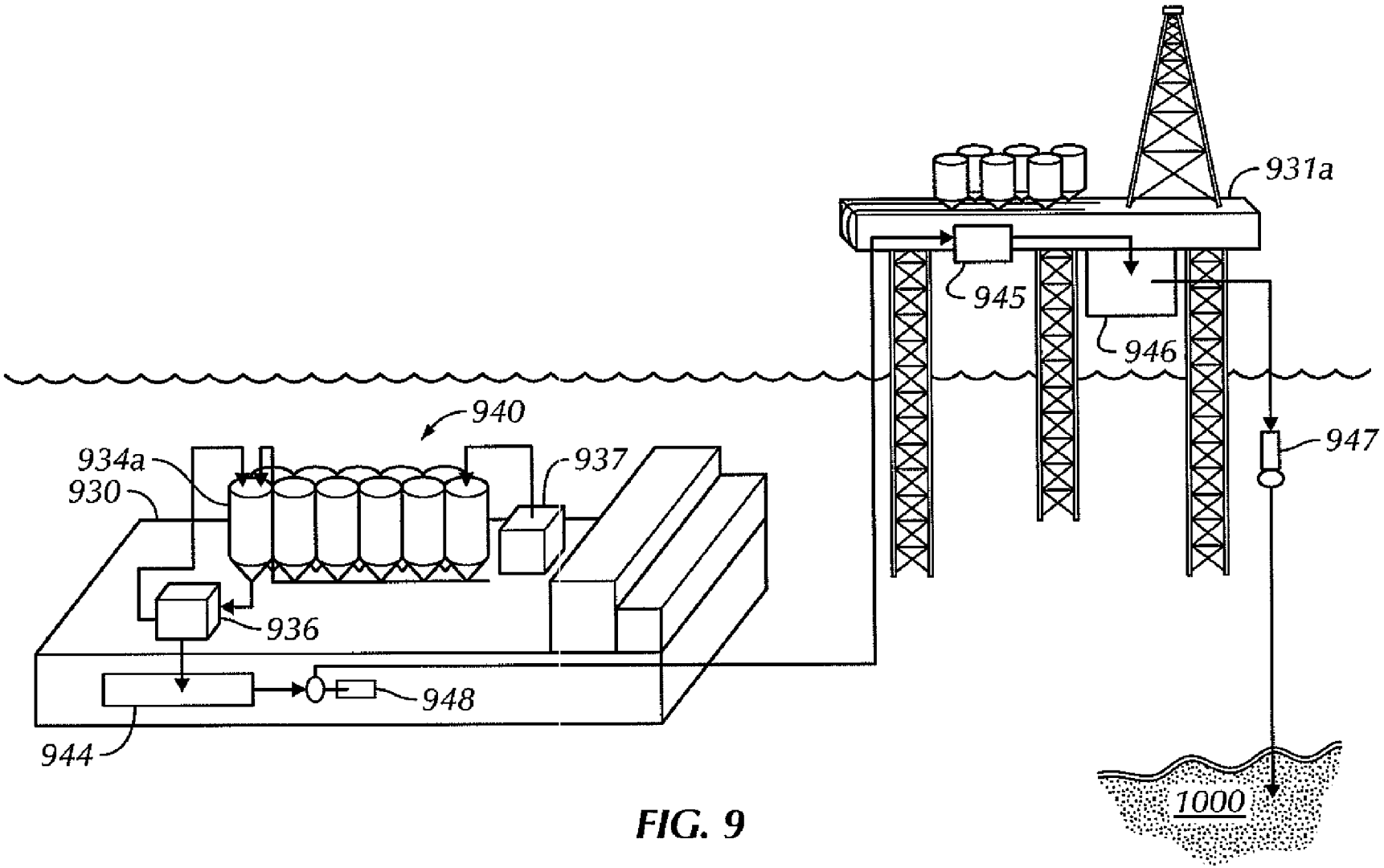
FIG. 9 shows an in-transit slurrification system in accordance with embodiments of the present disclosure.

The slurrification systems described below, with reference to FIGS. 7-9, are configured to combine drill cuttings with a fluid, such that a fluid with suspended particles is produced on a transport vehicle, while the transport vehicle is moving. The slurrification system disposed on the transport vehicle may operated while the transport vehicle is stationed proximate a work site and continue to operate as the transport vehicle moves away from the work site. Advantageously, and surprisingly, the inventors have discovered that by using embodiments as disclosed herein, the slurrification system may operate while the transport vehicle is in-transit between a first work site and a second work site, and/or operate while the transport vehicle is in-transit between two work sites and continue to operate after the transport vehicle is stationed at the second work site, which may reduce costs and/or drilling times.

Referring now to FIG. 7A, in one embodiment, a transport vehicle 730 may be stationed proximate a work site, for example, an offshore oil rig 731, as shown, an on-shore drilling rig (not shown), or an on-shore slurry facility (not shown). In this embodiment, at least one material stored in a storage vessel 735 disposed on the offshore oil rig 731 may be transferred to a storage assembly 733 disposed on transport vehicle 730 via at least one transfer line 732. Alternatively, the at least one material may be transferred to a storage tank (not shown) disposed on or below the deck of transport vehicle 730. In one embodiment, the material transferred may include drill cuttings or a slurry. In another embodiment, two discrete streams of material may be transferred to transport vehicle 730 via two transfer lines 732 and 732*a*. As discussed above, the materials transferred may include at least one of drill cuttings and fluids, wherein the fluids may include a liquid, a slurry, or other gelatinous material, and wherein the materials may be transferred contemporaneously. In one embodiment, a slurry formed from a slurrification systems 300, 500, or 600 may be transferred to transport vehicle 730.

In one embodiment, storage assembly 733 may include at least one cuttings storage vessel 734. In another embodiment, storage assembly 733 may include a plurality of cuttings storage vessels 734. In this embodiment, material from offshore oil rig 731 to transport vehicle 730 may be transferred to all but one of the cuttings storage vessels 734. In this embodiment, an empty cuttings storage vessel 734 may be configured to connect with a slurrification module 736, thus providing a slurrification system 740 on transport vehicle 730.

As shown in FIGS. 7B and 7C, at least one cuttings storage vessel 734 may be disposed below the deck 713 of the transport vehicle 730, i.e., a boat. In certain embodiments, storage assembly 733, including at least two cuttings storage vessels 734, may be disposed below the deck 713 of the transport vehicle 730 and at least one cuttings storage vessel 734 may be disposed on the deck 713 of the transport vehicle 730. The cuttings storage vessels disposed on the deck 713 of the transport vehicle 730 may be in fluid communication with the cuttings storage vessels disposed below the deck 713 of the transport vehicle 730.

Referring now to FIG. 8, slurrification system 840, disposed on transport vehicle 830, may include at least one cuttings storage vessel 834 operatively connected to a slurrification module 836. In one embodiment, a first cuttings storage vessel 834*a* may initially be substantially empty, while a second cuttings storage vessel 834*b* may contain drill cuttings and/or a fluid. While cuttings storage vessels 834*a*, 834*b* are shown disposed on the deck 813 of the transport vehicle 830, in other embodiments the cuttings storage vessels may be disposed below the deck 813 of the transport vehicle 830. Additional equipment, for example, slurrification module 836 and compressor 837, may also be disposed below the deck 813 of the transport vehicle 830 and operatively coupled to the cuttings storage vessels.

As described in detail above, slurrification module 836 may include an inlet connection 838 configured to connect with outlet 839 of first cuttings storage vessel 834*a*, and an outlet connection 841 configured to connect with an inlet 842 of first cuttings storage vessel 834*a*. Inlet connection 838 may be connected to outlet 839 and outlet connection 836 may be connected to inlet 842 by fluid transfer lines, for example, flexible hoses and/or new or existing piping. Module 836 may further include a grinding device (not shown) configured to facilitate the transfer of fluids from the first cuttings storage vessel 834*a*, through the module 836, and back to the first cuttings storage vessel 834*a*. The grinding device (not shown) is configured to reduce the particle size of solid materials of the drill cuttings transferred therethrough. The grinding device (not shown) may include a grinding pump, for example, a centrifugal pump, as disclosed in U.S. Pat. No. 5,129,469, previously incorporated by reference. Alternatively, the grinding device (not shown) may include a pump and a grinder.

In one embodiment, a pneumatic transfer device (not independently illustrated), as described above, may be coupled to the storage assembly 833 to transfer drill cuttings from any one of the cuttings storage vessels 834 to the first cuttings storage vessel 834*a*. In this embodiment, a compressor 837 may be coupled to at least one of the cuttings storage vessels 834, and may inject air via an air line 843, thereby transferring material contained within the storage vessels through a materials transfer line 844 to the first cutting storage vessel 834*a*.

In one embodiment, slurrification system 840 includes an independent power source (not shown) for providing power to components of module 836. The power source (not shown) is electrically connected to, for example, a grinding device and/or a programmable logic controller disposed in module 836. Those of ordinary skill in the art will appreciate that such a power source may provide primary or auxiliary power for powering components of module 836. In other embodiments, power source (not shown) may be merely an electrical conduit for connecting a power source (not shown) on transport vehicle 830 via an electrical cable (not shown) to module 836.

During operation of slurrification system 840, a fluid supply line (not shown) may be configured to supply a fluid to first cuttings storage vessel 834*a*. One of ordinary skill in the art will appreciate that the fluid supply line (not shown) may supply water, sea water, a brine solution, chemical additives, or other fluids known in the art for preparing a slurry of drill cuttings. In one embodiment, for example, as the transport vehicle is moving, a fluid supply line may be coupled to a series of bilge pumps which may be removing any inflow of sea water. As the fluid is pumped into first cuttings storage vessel 834*a*, cuttings from a second cuttings storage vessel 834*b*, or other components of the transport vehicles storage system, as described above, may be transferred into first cuttings storage vessel 834*a*.

As first cuttings storage vessel 834*a* fills with fluid and cuttings, the mixture of fluid and cuttings is transferred to module 836 through the inlet connection 838 of module 836. In one embodiment, the mixture may be transferred by a pneumatic transfer device, a vacuum system, a pump, or any other means known in the art. In one embodiment, the pneumatic transfer device may include a forced flow pneumatic transfer system. In one embodiment, the mixture of fluid and cuttings is pumped through a grinding device (not shown) disposed in module 836, wherein the cuttings are reduced in size. The mixture, or slurry, is then pumped back to first cuttings storage vessel 834*a* via outlet connection 841. The slurry may cycle back through module 836 one or more times as needed to produce a slurry of a predetermined density or concentration of cuttings as required for the particular application or re-injection formation.

In one embodiment, module 836 further includes a valve (not shown) disposed downstream of the grinding device (not shown), wherein the valve (not shown) is configured to redirect the flow of the slurry exiting the grinding device (not shown). In one embodiment, a PLC (not shown) may be operatively coupled to module 836 and configured to close or open the valve (not shown), thereby redirecting the flow of the slurry. Thus, the PLC may instruct the valve to move after a pre-determined amount of time of fluid transfer through module 836. In another embodiment, a sensor (not shown) may be operatively coupled to the valve to open or close the valve when a pre-determined condition of the slurry is met. For example, in one embodiment, a density sensor (not shown) may be coupled to the valve, such that, when the density of the slurry exiting the grinding device reaches a pre-determined value, the valve moves (i.e., opens or closes), and redirects the flow of the slurry from the first cuttings storage vessel 834*a* to another cuttings storage vessel 834 or a slurry tank 844.

In another embodiment, a conductivity sensor (not shown) may be coupled to the valve (not shown), such that, when the density of the slurry exiting the grinding device (not shown) reaches a pre-determined value, the valve moves and redirects the flow of the slurry from the first cuttings storage vessel 834*a* to another cuttings storage vessel 834 or slurry tank 844. One of ordinary skill in the art will appreciate that other apparatus and methods may be used to redirect the flow of the slurry once a predetermined concentration of cuttings in suspension, density, or conductivity has been met.

Slurry transferred to slurry tank 844 on transport vehicle 830 may be agitated to keep the solids of the slurry suspended in the fluid. One of ordinary skill in the art will appreciate that agitating the slurry may include manipulating the fluid to maintain solid suspension in the fluid. The agitation need not be continuous. Agitation units connected to slurry tank 844 for agitating the slurry may include, but are not limited to, screw augers and/or pumps and circulation systems. Those of ordinary skill in the art will appreciate that agitation may occur during specified time intervals, may be substantially continuous, or may be unnecessary.

In one embodiment, the slurry may be transported from one work site to a second work site for re-injection. For example, the slurry may be transported from an offshore rig to another offshore rig. Additionally, the slurry may be transported from an offshore rig to an on-land work site. Further, the slurry may be transported from an on-land work site to an offshore work site.

Referring now to FIG. 9, in one embodiment, a slurry formed by a slurrification system 940 disposed on a transport vehicle 930, as described above, may be transferred to another cuttings storage vessel, a slurry tank, a skip, or directly injected into a formation disposed at a second work site 931*a*. As illustrated, second work site 931*a* is an off-shore oil rig, but one of ordinary skill in the art will appreciate that the second work site may include an on-shore drilling rig or an on-shore disposal site. Slurry that is transferred to a tank, vessel, skip, or other storage device, may be transferred to the second work site 931*a* by any method known in the art, for example, lifting a cuttings storage device 934*a* (now containing slurry) off of the transport vehicle 930 by a crane. Alternatively, slurry formed on transport vehicle 930 may be transferred via pump 948 from slurry tank 944 to the second work site 931*a*.

In this embodiment, slurry formed on transport vehicle 930 may be transferred to second work site 931*a* for re-injection into a formation. As shown, slurry pumped from slurry tank 944 disposed on transport vehicle 930 is transferred to a classifying shaker 945, wherein the slurry is passed through a screen to separate or extract any remaining drill cuttings larger than a pre-determined size from the slurry, as required for the particular formation. The slurry is then transferred to a rig slurry tank 946 for storage. In certain embodiments, an agitation unit (not shown) may be coupled to tank 946 to maintain suspension of the solids particles in the fluid. A pump 947 in fluid communication with rig slurry tank 947 may then be actuated to pump the slurry from rig slurry tank 947 into formation 1000.

Those of ordinary skill in the art will appreciate the components of systems 300, 500, 600, 740, 840, and 940 may be interchanged, interconnected, and otherwise assembled in a slurrification system. As such, to address the specific requirements of a drilling operation the components of the systems and modules disclosed herein may provide for an interchangeable and adaptable system for slurrifcation at a drilling location.

Advantageously, embodiments disclosed herein may provide a slurrification system disposed on a moving transport vehicle that reduces the amount of required space at a work site to operate a slurrification system. In another aspect, embodiments disclosed herein may provide a slurrification system on a moving transport vehicle that allows a slurry to be formed while in-transit to another work site. In still another aspect, embodiments disclosed herein may provide a method and system of forming a slurry on a moving transport vehicle that may increase the efficiency of drilling systems and cuttings re-injections systems at a work site.

Furthermore, embodiments disclosed herein may provide a slurrification system that reduces the amount of equipment or number of components required to prepare a slurry for re-injection into a formation. In yet another aspect, embodiments disclosed herein may provide a safer slurrification system by reducing the number of crane lifts required to install the system.

Embodiments disclosed herein advantageously provide a module configured to connect to a cuttings storage vessel on a transport vehicle, thereby converting a cuttings storage vessel into a component of a slurrifcation system. As such, modules of the present disclosure may allow for existing infrastructure on a transport vehicle platform to perform multiple functions, such as, allowing cuttings storage vessels to be used in both the storage and transfer of cuttings, as well as being used in a slurrification system.

While the invention has been described with respect to a limited number of embodiments, those skilled in the art, having benefit of this disclosure, will appreciate that other embodiments may be devised which do not depart from the scope of the invention as disclosed herein. Accordingly, the scope of the invention should be limited only be the attached claims.

What is claimed:

1. A system for preparing slurry in-transit, the system comprising:

a first cuttings storage vessel disposed on a transport vehicle;

a module configured to operatively connect to the first cuttings storage vessel, the module comprising:

a grinding device configured to facilitate the transfer of fluids and reduce particle size of drill cuttings; and a fluid supply line in fluid communication with the first cuttings storage vessel, wherein the system is operated while the transport vehicle is moving.

2. The system of claim 1, wherein the grinding device comprises a pump and a grinder.

3. The system of claim 1, wherein the grinding device comprises a grinding pump.

4. The system of claim 1, further comprising a second cuttings storage vessel configured to supply cuttings to the first cuttings storage vessel.

5. The system of claim 4, further comprising a pneumatic transfer device configured to facilitate the transfer of cuttings from the second cuttings storage vessel to the first cuttings storage vessel.

6. The system of claim 5, wherein the pneumatic transfer device is disposed in the module.

7. The system of claim 1, wherein the module further comprises a valve configured to direct the flow of a mixture of fluid and drill cuttings exiting the grinding device.

8. The system of claim 1, further comprising a programmable logic controller configured to control at least one of the group consisting of a valve, a pneumatic transfer device, and a grinding device.

9. A method of operating an in-transit slurrification system, the method comprising:

using a first vessel disposed on a moving transport vehicle for cuttings storage; and operating the first vessel in a slurrification process while the transport vehicle is moving.

10. The method of claim 9, further comprising using the first vessel for cuttings transport.

11. The method of claim 9, wherein the operating the first vessel in the in-transit slurrification system comprises:

connecting a module to the first vessel, the module comprising:

a grinding device configured to facilitate the transfer of fluids;

an inlet connection configured to connect to an outlet of the first vessel; and an outlet connection configured to connect to an inlet of the first vessel.

12. The method of claim 11, further comprising providing a fluid to the first vessel.

13. The method of claim 12, further comprising transferring cuttings from a second vessel into the first vessel.

14. The method of claim 11, further comprising pumping a mixture of fluids and cuttings from the first vessel though the grinding device via the inlet connection of the module, and returning the mixture to the first vessel via the outlet connection.

15. The method of claim 11, further comprising transferring cuttings from a second vessel disposed on the moving transport vehicle to the first vessel.

16. A method of converting a first cuttings storage vessel for use in an in-transit slurrification system, comprising:

connecting a module to at least the first cuttings storage vessel disposed on a transport vehicle, while the transport vehicle is moving, wherein the module comprises:

a grinding device configured to facilitate the transfer of fluids;

an inlet connection configured to connect to an outlet of the first vessel; and an outlet connection configured to connect to an inlet of the first vessel.

17. The method of claim 16, herein the connecting the module comprises:

connecting a power supply of the module to a power source; and connecting at least one fluid transfer line from the module to the first cuttings storage vessel.

18. A method of operating an in-transit slurrification system, the method comprising:

transferring at least one material from a first vessel disposed at a work site to a storage assembly disposed on a transport vehicle via at least one transfer line;

disconnecting the at least one transfer line from the storage assembly;

connecting a slurrification module to the storage assembly;

moving the transport vehicle away from the work site; and operating the in-transit slurrification system while the transport vehicle is moving.

19. The method of claim 18, further comprising operating a slurrification system at the work site.

20. The method of claim 19, wherein the transferring the at least one material comprises transferring a slurry from the first vessel disposed at the work site to the storage assembly disposed on the transport vehicle.

21. The method of claim 18, wherein the at least one material comprises drill cuttings.

22. The method of claim 18, wherein the storage assembly comprises at least one cuttings storage vessel.

23. The method of claim 22, wherein the operating the in-transit slurrification system while the transport vehicle is moving comprises:

providing a fluid to a first cuttings storage vessel;

providing drill cuttings to the first cuttings storage vessel;

transferring a mixture of the fluid and the drill cuttings from the first cuttings storage vessel to the slurriflcation module;

processing the mixture through a grinding device disposed in the slurrification module; and returning the mixture to the first cuttings storage vessel.

* * * * *

UNITED STATES PATENT AND TRADEMARK OFFICE

CERTIFICATE OF CORRECTION

PATENT NO. : 7,770,665 B2
APPLICATION NO. : 12/020439
DATED : August 10, 2010
INVENTOR(S) : Jan Thore Eia et al.

It is certified that error appears in the above-identified patent and that said Letters Patent is hereby corrected as shown below:

In Claim 17, column 14, line 60, the word "herein" should read --wherein--.

Signed and Sealed this

Twelfth Day of October, 2010

David J. Kappos

David J. Kappos
*Director of the United States Patent and Trademark Office*